United States Patent [19]

Lübke

[11] Patent Number: 4,685,182

[45] Date of Patent: Aug. 11, 1987

[54] IMPRESSION CYLINDER FOR COOPERATION WITH A PRINTING CYLINDER

[75] Inventor: Herbert Lübke, Lienen, Fed. Rep. of Germany

[73] Assignee: Windmoller & Holscher, Lengerich, Fed. Rep. of Germany

[21] Appl. No.: 867,537

[22] Filed: May 28, 1986

[30] Foreign Application Priority Data

May 28, 1985 [DE] Fed. Rep. of Germany ..... 3519084

[51] Int. Cl.[4] ..... B21B 13/02; B30B 3/04; B41F 5/00

[52] U.S. Cl. ..... 29/116 R; 29/116 AD; 29/130; 100/162 B; 101/212

[58] Field of Search ..... 29/110, 116 R, 116 AD, 29/125, 130, 129.5; 100/162 B; 101/157, 212, 216, 219; 26/100, 101, 102

[56] References Cited

U.S. PATENT DOCUMENTS

| | | | |
|---|---|---|---|
| 3,094,771 | 6/1963 | Robertson | 29/116 AD |
| 3,099,072 | 7/1963 | Robertson et al. | 29/116 AD |
| 3,389,450 | 6/1968 | Robertson | 29/116 AD |
| 3,745,625 | 7/1973 | Jaegers et al. | 29/116 AD |
| 3,838,480 | 10/1974 | Depuy | 26/63 |
| 4,487,122 | 12/1984 | George et al. | 29/116 AD |

FOREIGN PATENT DOCUMENTS

| | | |
|---|---|---|
| 2033515 | 6/1972 | Fed. Rep. of Germany . |
| 2257947 | 6/1974 | Fed. Rep. of Germany . |
| 1511224 | 8/1975 | Fed. Rep. of Germany . |
| 2942002 | 5/1981 | Fed. Rep. of Germany . |
| 2081420 | 2/1982 | United Kingdom . |

*Primary Examiner*—Howard N. Goldberg
*Assistant Examiner*—Irene Graves Golabi
*Attorney, Agent, or Firm*—Fleit, Jacobson, Cohn & Price

[57] ABSTRACT

A radially deflectable impression cylinder, such as an impression cylinder for cooperation with a rotogravure printing cylinder. The impression cylinder includes a shell which is freely rotatably mounted on a stationary axle by means of annular members carrying a plurality of spaced rolling element bearings. At least an intermediate one of said annular members is radially displaceable in order to deflect the shell of the cylinder so that it assumes a bowed shape when viewed from the side.

16 Claims, 2 Drawing Figures

IMPRESSION CYLINDER FOR COOPERATION WITH A PRINTING CYLINDER

BACKGROUND OF THE INVENTION

1. Field of the Invention

This invention relates to a cylinder, preferably an impression cylinder for cooperation with a rotogravure printing cylinder. More particularly, the invention relates to a cylinder that includes a shell that is freely rotatably mounted on a stationary axle by means of annular members carrying a plurality of spaced rolling element bearings, wherein at least the intermediate ones of the annular members are radially displaceable in order to deflect the shell of the cylinder in a direction transverse to its longitudinal axis.

2. Description of the Prior Art

It is often desired to deflect a rotatable cylinder transversely relative its longitudinal axis so that the cylinder bows outwardly at the center and applies uniform pressure to a second cylinder which contacts the first-mentioned cylinder along a generatrix and has also been deflected, or that tends to deflect the first-mentioned cylinder. The pressure applied should compensate for the deflection of the second cylinder or should prevent a deflection of the first-mentioned cylinder. For example, in a rotogravure press the printing cylinder applies a substantial pressure to the impression cylinder and causes the latter to be radially deflected because it has lower flexural stiffness. That deflection often prevents a satisfactory imprint to be achieved.

German Patent Specification 15 11 224 discloses a deflectable cylinder that includes a shell rotatably mounted by means of rolling element bearings on a tubular axle, and the shell is adapted to be deflected by eccentric tie rods extending into the interior of the axle.

Published German Application 22 57 947 describes a deflectable cylinder that includes a shell mounted on annular members by means of rolling element bearings. The shell is rotatably mounted on stacks of leaf springs, which constitute the axle and which are adapted to be forced against each other in order to deflect the shell. The shell is deflected by a deflection of the axle, which consists of a tubular stack of leaf springs, and it is difficult to bend the shell exactly to the desired curvature. Moreover, the axle of such a cylinder has a substantial resilience and, as a result, only a low flexural stiffness, so that it cannot be satisfactorily used if the cylinder is required to apply substantial compressive stresses to a cooperating cylinder.

German Patent Publication 20 33 515 discloses a cylinder that can be deflected by the application of transverse forces to the journals protruding beyond the bearings.

German Patent Specification 29 42 002 discoses a cylinder that includes a shell freely rotatably mounted on a rigid axle by means of bearing elements having pockets for the application of hydrostatic pressure. The bearing elements have cylindrical bores, which receive piston-like pins that are connected to the axle. The cylindrical bores and the pockets are supplied with a fluid through the pins for the application of hydrostatic pressure. In that cylinder construction it is difficult to prevent tilting of the shell and it is also difficult to supply the fluid to and to withdraw it from the bearing elements and to control the bearing elements by means of the fluid.

It is an object of the present invention to provide a transversely deflectable cylinder that has a high flexural stiffness and that also permits a controlled transverse deflection of the shell of the cylinder, relative to its longitudinal axis, to be achieved in a simple manner.

SUMMARY OF THE INVENTION

The present invention is based on the recognition that a satisfactory imprint can be produced by a rotogravure press if the pressure forces that are exerted by the printing cylinder on the impression cylinder, and that tend to deflect the impression cylinder, are compensated in that the impression cylinder can be radially deflected in the opposite sense so that under the pressure applied by the printing cylinder the impression cylinder contacts the printing cylinder along a curved generatrix which is complementary to the adjacent generatrix of the printing cylinder to maintain line contact along the lengths of the cylinders, the deflection causing the line contact to be curvilinear.

Briefly stated, in accordance with one aspect of the present invention, a first cylinder is provided for cooperative engagement with an adjacent, substantially parallel second cylinder. The first cylinder includes a hollow cylindrical shell and a stationary axle positioned within the shell, the axle having an external, axially extending groove. A plurality of bearings is positioned in axially spaced relationship between the shell and the axle for freely rotatably supporting the shell on the axle. At least one of the bearings includes an annular member that is radially displaceable in order to deflect the shell radially outwardly relative to its axis at a point intermediate its ends. At least one pressure applying rod is axially slidably mounted in the groove in the axle, the rod having an external, radially outwardly facing tapered surface that engages an inside surface of the annular member. Displacement means carried on the axle are provided for axially displacing the at least one pressure-applying rod within the groove and relative to the axle to cause the tapered surface of the rod to move the annular member radially outwardly from the axle to deflect the shell radially outwardly to assume a bowed shape.

DESCRIPTION OF THE PREFERRED EMBODIMENT

Figure 1:
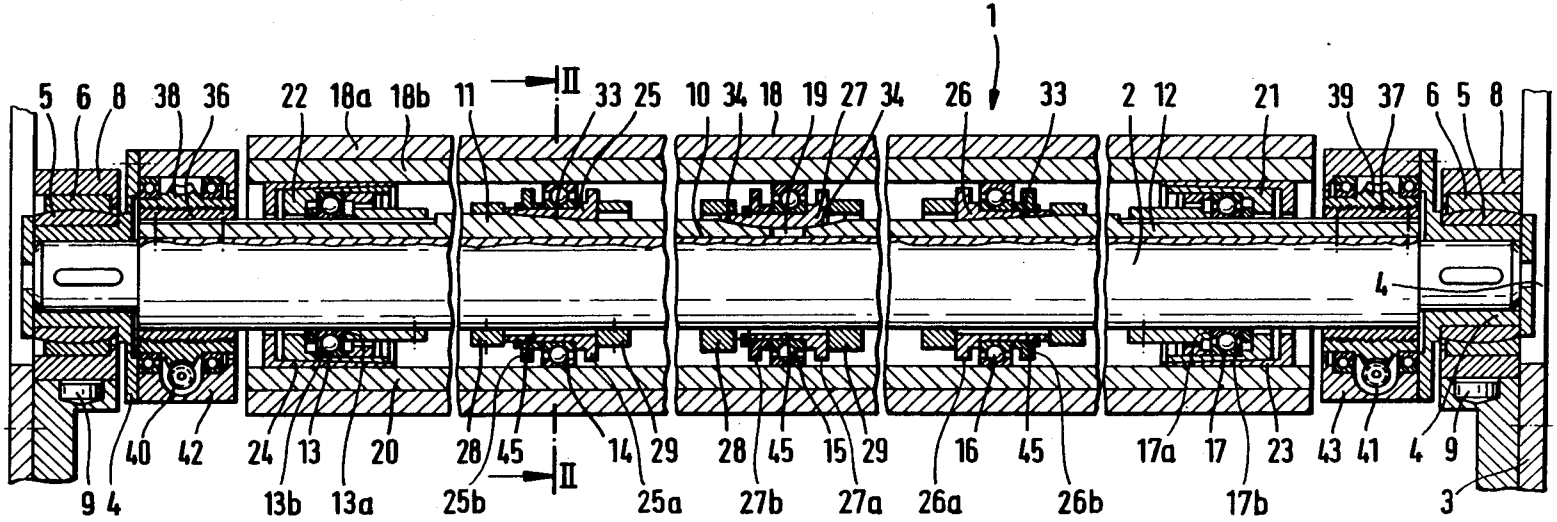
FIG. 1 is a longitudinal sectional view, partially broken away, showing an impression cylinder adapted for cooperation with an intaglio plate cylinder in a rotogravure printing press.

Referring now to the drawings, a portion of a rotogravure press is shown and includes a frame 3 that supports an impression cylinder 1 and a printing cylinder l*a*. The printing cylinder is shown only in FIG. 2 for purposes of clarity. The two cylinders are in substantially parallel relationship and are in contacting engagement at a nip through which a substrate passes, the substrate intended to be printed with an image that is carried on printing cylinder l*a* by means of a suitable ink pattern (not shown).

Cylinder 1 substantially coaxially surrounds an axle 2 that is preferably solid for purposes of rigidity, the axle being non-rotatably mounted in frame 3 by means of a pair of concentric rings 5 and 6 that support journals 4.

Secured to each opposite end of axle 2 is an annular housing member 42, 43, respectively, that surrounds an end of the axle and includes journals 4 that surround a respective stub end of the axle and around which ring 5 is secured. Ring 5 includes a spherical outer surface that is cooperatively engageable with a corresponding inner spherical surface on ring 6 to provide a ball-joint type arrangement at the ends of the axle so that deflection of axle 2 will not result in the transmission of bending moments to frame 3. Rings 6 are surrounded by outer rings 8, which are supported on and secured to machine frame 3. Additionally, pressure transducers 9 are provided in outer rings 8 so that transverse reaction forces at the ends of the axle can be measured.

Figure 2:
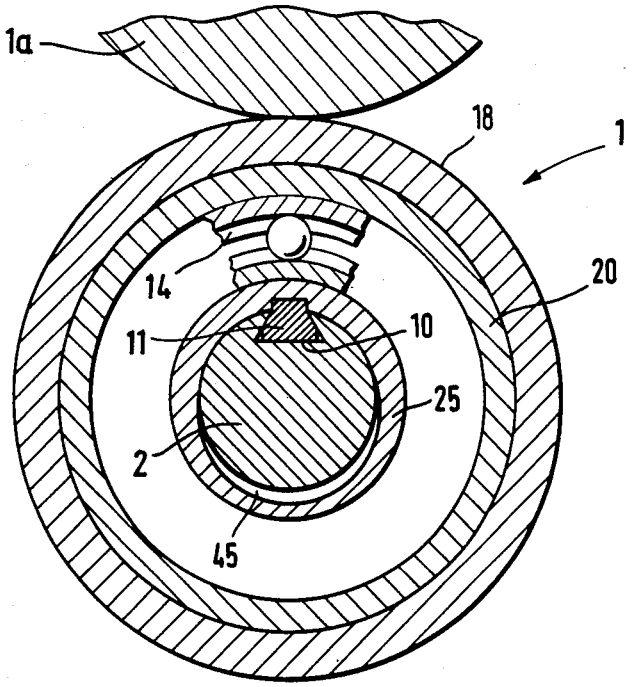
FIG. 2 is a transverse sectional view taken on line II—II in FIG. 1.

Axle 2 is generally cylindrical in form, and includes an axially extending groove 10 which is undercut on both longitudinal sides thereof to form a dovetail groove, as is more clearly apparent from FIG. 2 of the drawings. Groove 10 extends the entire axial length of axle 2. A pair of pressure-applying rods 11, 12, each having a dovetail cross section, are slidably positioned in groove 10. Rods 11 and 12 have innermost ends that are disposed near the length center of the cylinder and the inner ends are axially spaced to define a gap 19. The axially outermost surfaces of rods 11 and 12 are substantially parallel to the axis of axle 2, and the rods are tapered at inner positions thereof, the taper defined by a first external, radially outwardly facing tapered surface 33, as well as a second such tapered surface 34. Each of tapered surfaces 33 and 34 has a different degree of taper, that of surface 34 being a greater taper than that of surface 33, for reasons which will appear hereinafter.

Surrounding axle 2 is an outer shell 18, which is of hollow cylindrical or tubular form, and which can be formed from a pair of concentric tubes 18*a* and 18*b* as shown in FIG. 1, or, alternatively, it can be a single hollow tube. Shell 18 has an outer surface that defines the surface of an impression cylinder, and includes an inner surface that is provided with a series of axially spaced rolling element bearings 13, 14, 15, 16, and 17, which rotatably support shell 18 on axle 2.

Each of the rolling element bearings includes an outer race that is in contact with the inner surface of shell 18, either directly as in the case of intermediate bearings 14, 15, and 16, or indirectly, as in the case of end bearings 13 and 17. The inner races 13*a*, 17*a* of bearings 13 and 17, respectively, at the outer ends of the shell are secured in annular members 21, 22, which have a tapered outside peripheral surface. The annular members 21 and 22 are surrounded by annular members 23 and 24, respectively, which have a correspondingly tapered inside peripheral surface that is complementary to the outside peripheral surface of annular members 21 and 22. Screws (not shown) can be provided and can be tightened to force the annular members 21, 23 and the annular members 22, 24, against each other so that the inner shell tube surface is axially fixed to and rotatably mounted on axle 2 by means of the outer rolling element bearings 13 and 17. The inner races are mounted in a conventional manner, and the outer axial portions of pressure-applying rods 11 and 12 are completely within the groove 10, and are spaced inwardly of and do not interfere with the contact between inner races 13*a*, 17*a* and axle 2.

The intermediate bearings 14, 15, and 16 are rotatably mounted on the axle 2 by means of intermediate annular members 25, 26, and 27, respectively, and those annular members are supported on axle 2 against axial displacement by means of pairs of axially spaced stop rings 28, 29 that are suitably secured to axle 2, such as, for example, by radially extending screws (not shown). Stop rings 28, 29, are disposed on opposite sides of the annular members 25, 26, and 27. The inner races of bearings 14, 15, and 16 are secured to the outer periphery of the respective annular members in a conventional manner, such as, for example, between shoulders 25*a*, 26*a*, and 27*a* formed on the respective intermediate annular members, and against which the inner races rest, and a threaded clamping ring 25*b*, 26*b*, and 27*b* that is threadedly carried on the respective annular member on the other side of the inner race, as shown in FIG. 1. The outer races of intermediate bearings 14, 15, and 16, are carried by and bear against the inner surface of shell 18, and ball or roller elements are positioned between the inner and outer races, as is well known to those skilled in the art.

Intermediate annular members 25 and 26 each include a generally circular inner surface that surrounds axle 2, and that has a larger diameter than the outer diameter of axle 2. At the inner surface of each of intermediate annular members 25 and 26 that is adjacent the respective pressure applying rod 11, 12, the inner surface of the annular member is tapered in the same direction as is the respective pressure applying rod, and the external, radially outwardly facing tapered surface 33 of pressure-applying rod 11 is opposite to and in contact with the corresponding tapered surface of annular member 25. The same arrangement applies to pressure-applying rod 12 and annular member 26. Additionally, adjacent the innermost surfaces of pressure-applying rods 11 and 12, tapered surfaces 34 are opposite to and engage with correspondingly tapered inner surfaces of annular member 27. As earlier noted, the degree of taper at surfaces 34 is greater than the degree of taper at surfaces 33. Further, tapered surfaces 34 and the corresponding inner surface of annular member 27 can either be curved, as shown, or they can be a straight line taper.

Each of pressure-applying rods 11 and 12 is provided at its outermost axial end with a ring 36, that is secured to the respective rod by means of radially-extending screws (not shown). Each of rings 36 and 37 includes an outer screw thread that is in threaded engagement with corresponding internal screw threads formed on cooperatively engaging worm wheels 38 and 39, respectively. The outermost surfaces of each of worm wheels 38 and 39 include a worm gear, that is rotatably carried in respective annular housing members 42, 43, by means of a pair of axially spaced bearings. A worm 40, 41 is provided for meshing engagement with respective worm wheels 38 and 39 and is rotatably carried in respective annular housing members 42 and 43. Each of worms 40 and 41 can be provided with a handle (not shown) for rotating the worm, or, alternatively, suitable powered driving means (not shown) provided to impart rotary motion to the respective worms.

As best seen in FIG. 2, the respective annular members 25, 26, and 27, have an axis that is parallel to but offset from the axis of axle 2. As a result, a crescent-shaped gap 45 exists between the respective annular members and the axle. That gap is also visible in FIG. 1, which shows the lowermost portions of the inner surface of annular members 25, 26, and 27, spaced from the surface of axle 2, whereas the uppermost surfaces of the respective annular members is in contact with respective portions of pressure-applying rods 11 and 12.

In operation, rotation of worms 40, 41, causes rotation about the axis of axle 2 of worm wheels 38 and 39, which, in turn, cause axial movement of rings 36 and 37 by means of the threaded connection therebetween. By virtue of the connection between rings 36 and 37 with pressure-applying rods 11 and 12, respectively, the latter are moved either inwardly or outwardly, depending upon the direction of rotation of worms 40, 41, and upon inward movement the tapered surfaces of the pressure-applying rods cause the respective annular members 25, 26, and 27, as well as their respective bearings 14, 16, and 15, to move in a radially outward direction relative to the axis of axle 2. Further, because the degree of taper is greater at the innermost portions of the respective pressure-applying rods, bearing 15 is moved radially outwardly a greater distance than are bearings 14 and 16, and consequently shell 18 is bowed in an upward direction, as viewed in FIG. 1, by virtue of the deflection imparted to shell 18. The radial movement of the respective bearings is permitted by virtue of the crescent-shaped gaps 45 between the respective annular members and the axle.

Thus it can be seen that the present invention permits a controlled deflection to be imparted to shell 18 of the impression cylinder, so that compensation can be effected for deflection in cooperating printing cylinder 1*a* (see FIG. 2) to thereby provide a continuous line contact between the respective cylinders, regardless of the loading that is applied thereto. Further, the deflection of the cylinder is accomplished without a corresponding deflection of the axle. Thus, because the cylinder of the present invention can take up considerable compressive stresses, it can be used to special advantages an impression cylinder in cooperation with a rotogravure printing cylinder.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed:

1. A cylinder for cooperative engagement with an adjacent substantially parallel cylinder, comprising: (a) a hollow cylindrical shell; a stationary axle positioned within said shell, said axle having an external, axially extending groove; (b) a plurality of bearing means positioned in axially spaced relationship between said shell and said axle for freely rotatably supporting said shell on said axle, at least one of said bearing means including an annular member that is radially displaceable in order to deflect said shell radially outwardly relative to its axis at a point intermediate its ends; (c) at least one pressure-applying rod axially slidably mounted in said groove, said rod having an external, radially outwardly facing tapered surface that engages an inside surface of said annular member; and (d) displacement means carried on said axle for axially displacing said at least one pressure-applying rod within said groove and relative to said axle, to cause said tapered surface of said rod to move said annular member radially outwardly from said axle to deflect said shell radially outwardly to assume a bowed shape.

2. A cylinder according to claim 1, wherein the radially displaceable annular member includes an axially tapered inner surface which is positioned opposite to and in contacting engagement with the tapered surface of the at least one pressure-applying rod.

3. A cylinder according to claim 1, wherein said radially displaceable annular member has an inner surface defined by a diameter greater than the diameter of said axle and having an axis radially offset from and substantially parallel to the axis of said axle to define a crescent-shaped gap between said annular member and said axle.

4. A cylinder according to claim 1, including a pair of stop rings secured to said axle and on opposite sides of said annular member to restrain said annular member against axial movement along said axle.

5. A cylinder according to claim 1, wherein said groove is undercut to form a dovetail groove and the at least one pressure-applying rod has in cross-section a trapezoidal shape which is complementary to and slidably receivable in said groove.

6. A cylinder according to claim 1, wherein the degree of taper of the tapered surface of said at least one pressure-applying rod increases from annular member to annular member in the direction from the end of the cylinder to the length center thereof.

7. A cylinder according to claim 1, wherein two pressure-applying rods are provided in said groove and are arranged in mirror symmetry and adjacent to the length center of the cylinder in axially spaced relation to define a gap between them, and each of said rods has an innermost tapered surface adjacent to its inner end, said inner tapered surfaces being tapered in mutually opposite senses and bearing against an annular member that is substantially centrally positioned along the axis of said axle.

8. A cylinder according to claim 1, wherein said displacement means includes a ring connected to an axially outer end of said pressure-applying rod and said ring includes external screw threads, an internally threaded worm wheel in threaded engagement with said ring, and a rotatable worm that is mounted in a fixed position relative to said axle and in driving engagement with said worm wheel.

9. A printing press including a printing cylinder and an impression cylinder, said press comprising:

(a) a frame;

(b) a printing cylinder rotatably carried in said frame and having an external ink pattern defining an image to be printed on a substrate; and (c) an impression cylinder rotatably carried in said frame and substantially parallel to and in contact with said printing cylinder, said impression cylinder including:

(1) a hollow cylindrical shell;

(2) a stationary axle positioned within said shell, said axle having an external, axially extending groove;

(3) a plurality of bearing means positioned in axially spaced relationship between said shell and said axle for freely rotatably supporting said shell on said axle, at least one of said bearing means including an annular member that is radially displaceable in order to deflect said shell radially outwardly relative to its axis at a point intermediate its ends;

(4) at least one pressure-applying rod axially slidably mounted in said groove, said rod having an external, radially outwardly facing tapered surface that engages an inside surface of said annular member; and (5) displacement means carried on said axle for axially displacing said at least one pressure-applying rod within said groove and relative to said axle to cause said tapered surface of said rod to move said annular member radially outwardly from said axle to deflect said shell radially outwardly to provide contact between said printing cylinder and said impression cylinder in the axial direction.

10. A printing press according to claim 9, wherein the radially displaceable annular member includes an axially tapered inner surface which is positioned opposite to and in contacting engagement with the tapered surface of the at least one pressure-applying rod.

11. A printing press according to claim 9, wherein wherein said radially displaceable annular member has an inner surface defined by a diameter greater than the diameter of said axle and having an axis radially offset from and substantially parallel to the axis of said axle to define a crescent-shaped gap between said annular member and said axle.

12. A printing press according to claim 9, including a pair of stop rings secured to said axle and on opposite sides of said annular member to restrain said annular member against axial movement along said axle.

13. A printing press according to claim 9, wherein said groove is undercut to form a dovetail groove and the at least one pressure-applying rod has in cross-section a trapezoidal shape which is complementary to and slidably receivable in said groove.

14. A printing press according to claim 9, wherein the degree of taper of the tapered surface of said at least one pressure-applying rod increases from annular member to annular member in the direction from the end of the cylinder to the length center thereof.

15. A printing press according to claim 9, wherein two pressure-applying rods are provided in said groove and are arranged in mirror symmetry and adjacent to the length center of the cylinder in axially spaced relation to define a gap between them, and each of said rods has an innermost tapered surface adjacent to its inner end, said inner tapered surfaces being tapered in mutually opposite senses and bearing against an annular member that is substantially centrally positioned along the axis of said axle.

16. A printing press according to claim 9, wherein said displacement means includes a ring connected to an axially outer end of said pressure-applying rod and said ring includes external screw threads, an internally threaded worm wheel in threaded engagement with said ring, and a rotatable worm that is mounted in a fixed position relative to said axle and in driving engagement with said worm wheel.

* * * * *